US009874837B2

(12) United States Patent
Yoshioka et al.

(10) Patent No.: US 9,874,837 B2
(45) Date of Patent: Jan. 23, 2018

(54) CHARGING MECHANISM AND IMAGE FORMING APPARATUS

(71) Applicant: FUJI XEROX CO., LTD., Tokyo (JP)

(72) Inventors: Tomoaki Yoshioka, Kanagawa (JP); Yoko Miyamoto, Kanagawa (JP); Yasuhiro Shimada, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/232,904

(22) Filed: Aug. 10, 2016

(65) Prior Publication Data

US 2017/0212453 A1 Jul. 27, 2017

(30) Foreign Application Priority Data

Jan. 22, 2016 (JP) ..... 2016-010339

(51) Int. Cl.
*G03G 15/16* (2006.01)

(52) U.S. Cl.
CPC ..... *G03G 15/1665* (2013.01); *G03G 15/1605* (2013.01); *G03G 15/1695* (2013.01)

(58) Field of Classification Search
CPC ..... G03G 15/1665; G03G 15/1695; G03G 15/1605
See application file for complete search history.

(56) References Cited

U.S. PATENT DOCUMENTS 5,140,375 A * 8/1992 Shindo ..... G03G 15/1695 271/193
5,740,508 A 4/1998 Matsuura et al.
2002/0064405 A1* 5/2002 Tomiki ..... G03G 15/6558 399/316
2011/0033212 A1* 2/2011 Suzuki ..... G03G 15/161 399/296
2015/0160589 A1* 6/2015 Hayami ..... G03G 15/1695 399/390

FOREIGN PATENT DOCUMENTS

JP 8-202177 A 8/1996
JP 2001-194916 A 7/2001

* cited by examiner

*Primary Examiner* — Rodney Bonnette
(74) *Attorney, Agent, or Firm* — Sughrue Mion, PLLC

(57) ABSTRACT

An image forming apparatus includes multiple image carriers for carrying toner images of different colors; an intermediate transfer body for carrying the toner images transferred from the multiple image carriers; a second transfer part for transferring the toner images carried by the intermediate transfer body to a recording medium at a second transfer position; and a charge-applying part for applying a charge having a same polarity as a charging polarity of toner used to form the toner images to at least one of a leading end and a trailing end of the recording medium in a transport direction, at a position on an upstream side of the second transfer part in the transport direction of the recording medium.

7 Claims, 13 Drawing Sheets

| EVALUATION POSITION | 1 | 2 | 3 | 4 | 5 |
|---|---|---|---|---|---|
| CONDITION 1 | 0 V | −800 V | −800 V | −800 V | −800 V |
| CONDITION 2 | 0 V | −350 V | −650 V | −1100 V | −1500 V |
| CONDITION 3 | 0 V | −350 V | −500 V | −1350 V | −2100 V |

| EVALUATION POSITION | 1 | 2 | 3 | 4 | 5 |
|---|---|---|---|---|---|
| CONDITION 1 | −800 V | −800 V | −800 V | −800 V | −800 V |
| CONDITION 2 | −1500 V | −1500 V | −1500 V | −1500 V | −1500 V |
| CONDITION 3 | −2100 V | −2100 V | −2100 V | −2100 V | −2100 V |

CHARGING MECHANISM AND IMAGE FORMING APPARATUS

CROSS-REFERENCE TO RELATED APPLICATIONS

This application is based on and claims priority under 35 USC 119 from Japanese Patent Application No. 2016-010339 filed Jan. 22, 2016.

BACKGROUND

Technical Field

The present invention relates to image forming apparatuses.

SUMMARY

According to an aspect of the invention, there is provided an image forming apparatus includes multiple image carriers for carrying toner images of different colors; an intermediate transfer body for carrying the toner images transferred from the multiple image carriers; a second transfer part for transferring the toner images carried by the intermediate transfer body to a recording medium at a second transfer position; and a charge-applying part for applying a charge having a same polarity as a charging polarity of toner used to form the toner images to at least one of a leading end and a trailing end of the recording medium in a transport direction, at a position on an upstream side of the second transfer part in the transport direction of the recording medium.

BRIEF DESCRIPTION OF THE DRAWINGS

Exemplary embodiments of the present invention will be described in detail based on the following figures, wherein.

DETAILED DESCRIPTION

Exemplary embodiments of the present invention will be described below with reference to the drawings.

First Exemplary Embodiment

Figure 1:
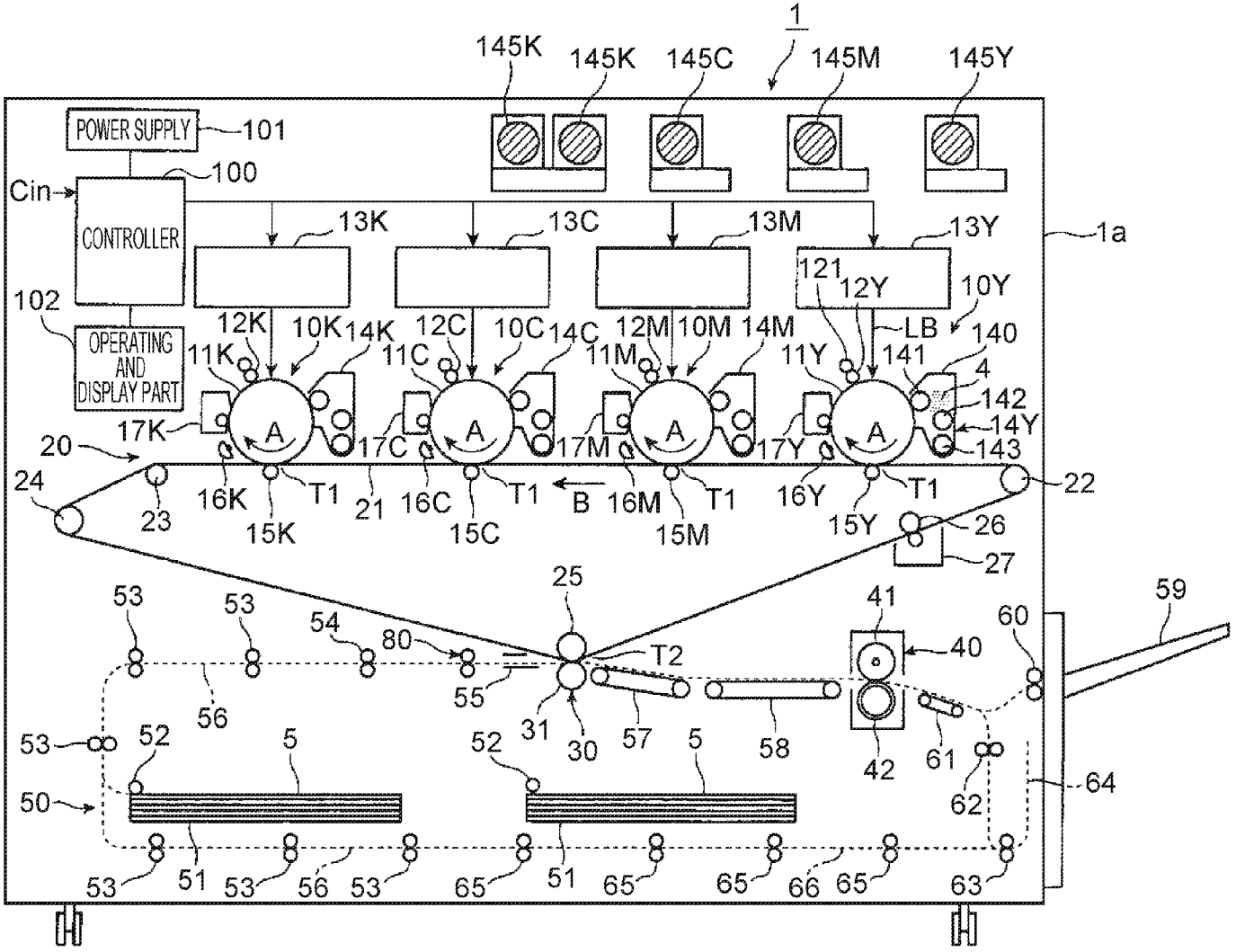
FIG. 1 shows the overall configuration of an image forming apparatus according to a first exemplary embodiment of the present invention.

FIG. 1 shows, in outline, the overall configuration of an image forming apparatus according to a first exemplary embodiment of the present invention.

Overall Configuration of Image Forming Apparatus

An image forming apparatus 1 according to the first exemplary embodiment is configured as, for example, a color printer. The image forming apparatus 1 includes image forming units 10, which form toner images developed with toner, serving as developer 4; an intermediate transfer device 20, which carries the toner images formed by the image forming units 10 and transports them to a second transfer position T2, where the toner images are second-transferred to a recording sheet 5, serving as an example of a recording medium; a paper feed device 50, which accommodates and transports recording sheets 5 to be fed to the second transfer position T2 of the intermediate transfer device 20; a fixing device 40, which fixes the toner images second-transferred to the recording sheet 5 by the intermediate transfer device 20; etc. Reference sign la in FIG. 1 denotes the body of the image forming apparatus 1, and the body la includes a support structure member, an outer covering, etc. Furthermore, a dashed line in FIG. 1 shows a major transport path in the body la, along which the recording sheet 5 is transported.

The image forming units 10 include four image forming units 10Y, 10M, 10C, and 10K, which form a yellow (Y), magenta (M), cyan (C), and black (K) toner image, respectively. The four image forming units 10 (Y, M, C, and K) are arranged side-by-side in a line, in the horizontal direction, inside the body 1*a*.

The image forming units 10 (Y, M, C, and K) include rotatable photoconductor drums 11, serving as an example of an image carrier. The photoconductor drums 11 are surrounded by: charging devices 12 for charging, to predetermined electric potentials, the circumferential surfaces (image carrying surfaces) of the photoconductor drums 11 on which images can be formed; exposure devices 13 (Y, M, C, and K), which irradiate the charged circumferential surfaces of the photoconductor drums 11 with light based on image information (signal) to form electrostatic latent images corresponding to the respective colors, which have potential differences; developing devices 14 (Y, M, C, and K), serving as an example of a developing part, which develop the electrostatic latent images with the toner in the developer 4 of the corresponding color (Y, M, C, and K) into toner images; first transfer devices 15 (Y, M, C, and K), serving as an example of a first transfer part, which transfer the toner images to the intermediate transfer device 20; erase lamps 16 (Y, M, C, and K), which remove the residual charge remaining on the image carrying surfaces of the photoconductor drums 11 after the first transfer; drum cleaning devices 17 (Y, M, C, and K), which remove attached substances, such as toner, remaining on the image carrying surfaces of the photoconductor drums 11 after the first transfer to clean the photoconductor drums 11; etc.

The photoconductor drums 11 each include a grounded hollow or solid cylindrical base, and an image carrying surface, which has a photoconductive layer (photosensitive layer) formed of a photosensitive material, formed on the circumferential surface thereof. The photoconductor drum 11 is supported so as to be rotatable in the direction indicated by an arrow A by receiving a motive force supplied from a driving device (not shown).

The charging device 12 includes a contact-type charging roller, which is disposed so as to be in contact with the photoconductor drum 11. The charging device 12 includes a cleaning roller 121 for cleaning the surface thereof. The charging device 12 receives a charging voltage. If the developing device 14 performs reversal development, the charging voltage is a voltage or current having the same polarity as the charging polarity of the toner supplied by the developing device 14. Note that a non-contact charging device, such as scorotron, which is disposed so as not to be in contact with the surface of the photoconductor drum 11, may be used as the charging device 12.

The exposure device 13 irradiates the charged circumferential surface of the photoconductor drum 11 with light LB (indicated by a solid line with an arrowhead), which is generated corresponding to the image information input to the image forming apparatus 1, to form an electrostatic latent image. The exposure devices 13 (Y, M, C, and K) correspond to the yellow (Y), magenta (M), cyan (C), and black (K) image forming units 10. When latent images are to be formed, the exposure devices 13 receive, from the controller 100, full-color or black-and-white image information (signal) input to the image forming apparatus 1 through an arbitrary device. The exposure devices 13 may be formed of light-emitting-diode (LED) print heads, in which multiple LEDs, serving as light-emitting devices arranged in the axial direction of the photoconductor drums 11 of the image forming units 10, irradiate the photoconductor drums 11 with light corresponding to the image information, thereby forming electrostatic latent images.

The developing devices 14 (Y, M, C, and K) each include, inside a device housing 140 having an opening and a developer container chamber, a developing roller 141, serving as an example of a developer carrier, which carries and transports the developer 4 to a developing area where it faces the photoconductor drum 11; a supply-and-transport member 142, such as a screw auger, which supplies the developer 4 to the developing roller 141 while stirring; a stir-and-transport member 143, such as a screw auger, which stirs and transports the developer 4 while exchanging the developer 4 with the supply-and-transport member 142; and a layer-thickness restricting member (not shown), which restricts the amount (layer thickness) of developer 4 carried by the developing roller 141. The developers 4 of four colors (Y, M, C, and K) are two-component developers, each containing a nonmagnetic toner and a magnetic carrier.

The first transfer devices 15 (Y, M, C, and K) are contact-type transfer devices, which are rotated while being in contact with the circumferences of the corresponding photoconductor drums 11 with the intermediate transfer belt 21 therebetween, and which have first transfer rollers supplied with first transfer voltages. The first transfer voltages are direct-current voltages having the opposite polarity to the charging polarity of the toner and supplied from a power supply device (not shown).

The erase lamps 16 uniformly expose the surfaces of the photoconductor drums 11 to the light after the first transfer, thereby removing the residual charges on the surfaces of the photoconductor drums 11.

The drum cleaning devices 17 each include: a partially open container-shaped body; a cleaning plate disposed so as to be in contact with the circumferential surface of the photoconductor drum 11 after the first transfer at a predetermined pressure to remove attached substances, such as residual toner, to clean the photoconductor drum 11; and a delivery member, such as a screw auger, which recovers the attached substances, such as toner, removed by the cleaning plate and delivers the toner to a recovery system (not shown).

As shown in FIG. 1, the intermediate transfer device 20 is disposed below the image forming units 10 (Y, M, C, and K). The intermediate transfer device 20 is primarily formed of: an intermediate transfer belt 21, which is rotated in a direction indicated by an arrow B, while passing through first transfer positions T1 between the photoconductor drums 11 and the first transfer devices 15 (first transfer rollers); multiple belt-support rollers 22 to 26, which support the intermediate transfer belt 21 from the inside in a desired state so as to be able to revolve; a second transfer device 30, serving as an example of a second transfer part, which is disposed on the outer circumferential surface (image carrying surface) of the intermediate transfer belt 21 supported by the belt-support roller 25 and second-transfers the toner images on the intermediate transfer belt 21 to a recording sheet 5; and a belt cleaning device 27, which removes attached substances, such as toner and paper dust, remaining on the outer circumferential surface of the intermediate transfer belt 21 after passing through the second transfer device 30 to clean the outer circumferential surface of the intermediate transfer belt 21.

The intermediate transfer belt 21 is an endless belt formed of a material composed of, for example, a synthetic resin, such as polyimide resin or polyamide resin, with a resistance adjusting agent, such as carbon black, dispersed therein. The belt-support roller 22 serves as a driving roller that is rotationally driven by a driving device (not shown), the belt-support roller 23 serves as a surface-forming roller that forms the image forming surface of the intermediate transfer belt 21, the belt-support roller 24 serves as a tension roller for applying tension to the intermediate transfer belt 21 and as a meandering correction roller for correcting meandering of the intermediate transfer belt 21, the belt-support roller 25 serves as a second-transfer back-support roller, and the belt-support roller 26 serves as an opposing roller for the belt cleaning device 27.

Figure 2:
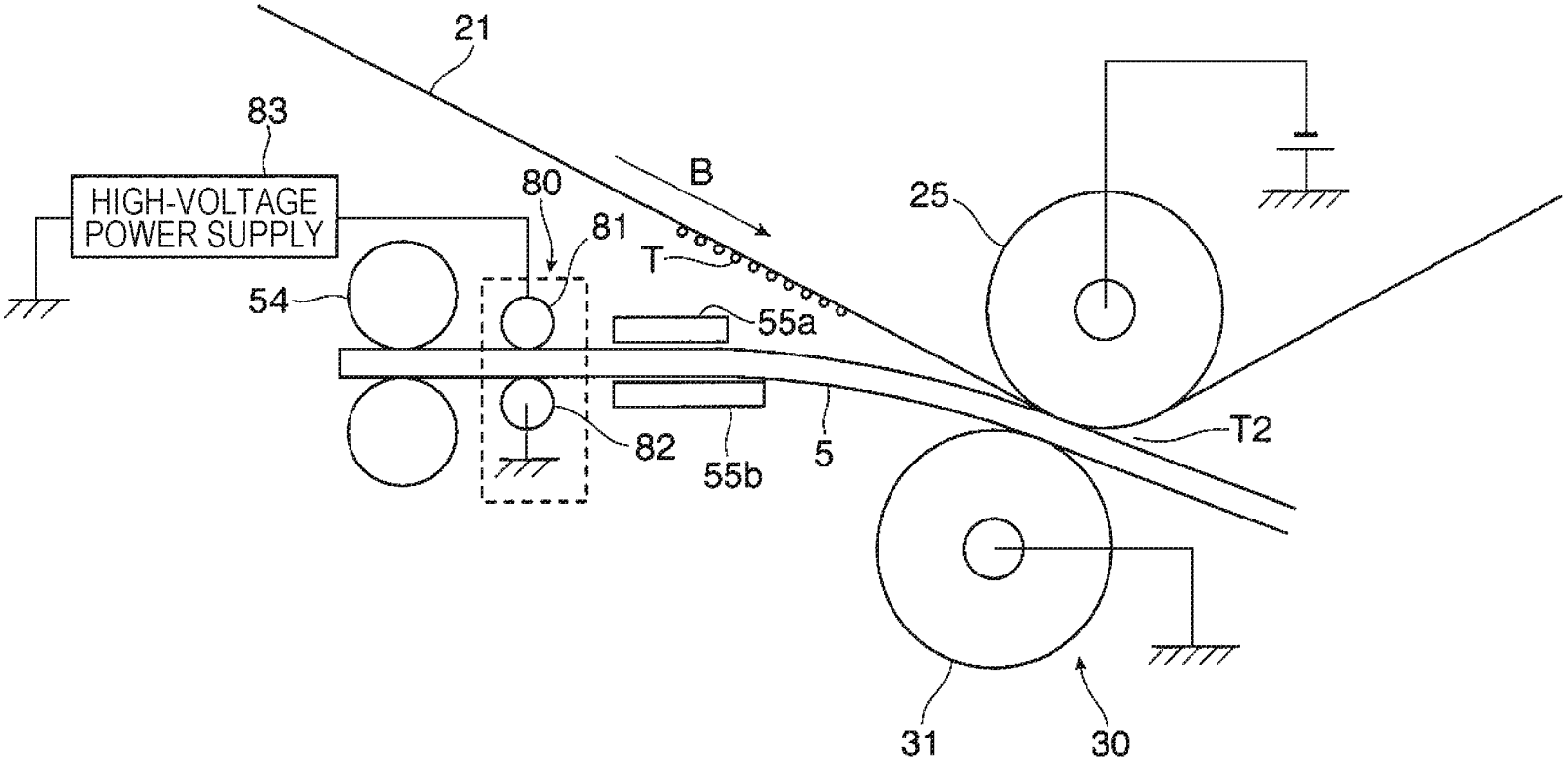
FIG. 2 shows, in an enlarged manner, the configuration of a relevant part of the image forming apparatus according to the first exemplary embodiment of the present invention.

The second transfer device 30 is a contact-type transfer device having a second transfer roller 31, which constitutes a second transfer part, which is rotated by being in contact with the circumferential surface of the intermediate transfer belt 21 at the second transfer position T2, which is a position on the outer circumferential surface of the intermediate transfer belt 21 supported by the belt-support roller 25, in the intermediate transfer device 20, and to which a second transfer voltage is supplied. The second transfer device 30 includes the second transfer roller 31 and the belt-support roller 25, serving as a backup roller. A direct-current voltage, serving as a second transfer voltage, which has the opposite polarity to or the same polarity as the charging polarity of the toner is applied to the second transfer roller 31 or the belt-support roller 25. In this exemplary embodiment, as shown in FIG. 2, a direct-current high voltage having the same (negative) polarity as the charging polarity of the toner is applied, as the second transfer voltage, to the belt-support roller 25. The second transfer roller 31 is grounded.

The belt cleaning device 27 has the same configuration as the drum cleaning devices 17 and includes a partially open container-shaped body, a cleaning plate (not shown) disposed so as to be in contact with the circumferential surface of the intermediate transfer belt 21 after the second transfer at a predetermined pressure to remove attached substances, such as residual toner, to clean the circumferential surface of the intermediate transfer belt 21, and a delivery member, such as a screw auger (not shown), which recovers the attached substances, such as toner, removed by the cleaning plate and delivers the toner to a recovery system.

The fixing device 40 includes a roller-shaped or belt-shaped heating rotary member 41, which is heated by a heating device such that the surface thereof is maintained at a predetermined temperature, and a roller-shaped or belt-shaped pressure-applying rotary member 42, which extends parallel to the axial direction of the heating rotary member 41 and is rotated by being in contact therewith at a predetermined pressure. In the fixing device 40, a contact part where the heating rotary member 41 and the pressure-applying rotary member 42 are in contact with each other serves as a fixing part at which predetermined fixing processing (heating and pressing) is performed.

The paper feed device 50 is disposed below the intermediate transfer device 20. The paper feed device 50 is primarily formed of multiple (or a single) sheet containers 51 for accommodating a stack of recording sheets 5 of a desired size and type, and delivery devices 52 for picking up recording sheets 5 one-by-one from the sheet containers 51. The sheet containers 51 are attached such that they can be pulled toward, for example, the front side (i.e., the side to which a user faces when using the image forming apparatus 1) of the body la.

Examples of the recording sheet 5 include normal paper used in copiers and printers of an electrophotographic system, thin paper, such as tracing paper, and OHP sheets. For an even smoother image surface after fixing, it is preferable that the surface of the recording sheet 5 be as smooth as possible, and hence, for example, coated paper formed by coating the surface of normal paper with resin or the like, and so-called thick paper, such as art paper for printing, which has a relatively large grammage, may also be suitably used. Herein, recording sheets 5 having a grammage of less than 80 g/m$^2$ are classified as thin paper, recording sheets 5 having a grammage of greater than or equal to 80 g/m$^2$ to less than 100 g/m$^2$ are classified as normal paper, recording sheets 5 having a grammage of greater than or equal to 100 g/m$^2$ to less than 200 g/m$^2$ are classified as first thick paper, and recording sheets 5 having a grammage of greater than or equal to 200 g/m$^2$ are classified as second thick paper. Note that these thresholds for distinguishing the thin paper, the normal paper, the first thick paper and the second thick paper from one another are merely examples and are not intended to be limiting.

As described above, various types of paper may be used as the recording sheet 5. The recording sheet 5 is deformed (e.g., bent or flexed) while being transported inside the image forming apparatus 1. For example, the grammage and the rigidity (flexural rigidity) show the ease of bending of the recording sheet 5. The grammage is the weight (g/m$^2$) per unit area (1 m$^2$) of the recording sheet 5. Because the thickness of the recording sheet 5 tends to increase with the weight thereof, the grammage is also used to mean the "paper thickness". However, some relatively thick recording sheets 5 have a relatively low density of fibers constituting the sheets. Hence, the grammage does not always correspond to the "paper thickness".

The rigidity (flexural rigidity) of the recording sheet 5 may be expressed by a value measured by "paper and board-determination of stiffness-taber stiffness tester method", specified in JIS P 8125, which is in compliance with ISO 2493 or ISO 2493. The rigidity of the recording sheet 5 is expressed by the bending moment or load needed to bend, by 15 degrees at a constant speed, a specimen that has been conditioned for 24 hours under standard conditions (23° C., 50% RH), cut into a piece having a width of 38.0 mm and a length of 50.0 mm, and fixed at one end (short side) in a cantilever manner. In this exemplary embodiment, the flexural rigidity of the recording sheet 5 is expressed by a measurement value (mN) obtained by testing a specimen that is cut out, into a width of 38 mm and a length of 50 mm, of a recording sheet 5 that has been conditioned for 24 hours or more under standard conditions (23° C. and 50% RH), by using a flexural rigidity test machine (model number 2048-BF), manufactured by Kumagai riki kogyo Co., Ltd., with the bending angle being set to 15 degrees and the specimen support span to 10 mm, in compliance with ISO 2493.

The flexural rigidity of the recording sheet 5 may vary according to the paper feed direction (LEF: long edge feed or SEF: short edge feed) due to the orientation of fibers or the like. LEF means that paper is fed with the long edge as the leading edge, while SEF means that paper is fed with the short edge as the leading edge. Herein, the LEF direction is employed as the standard paper feed direction, and the flexural rigidity in the LEF direction is used as the flexural rigidity of the recording sheet 5. When the flexural rigidity significantly varies according to the paper feed direction (LEF or SEF) of the recording sheet 5, the flexural rigidity in the LEF direction or the flexural rigidity in the SEF direction may be independently used according to the paper feed direction.

A feed-and-transport path 56, which includes multiple (or single) sheet-transport roller pairs 53 and 54, a transport guide 55 for transporting the recording sheet 5 fed out of the paper feed device 50 to the second transfer position T2, and the like are provided between the paper feed device 50 and the second transfer device 30. As shown in FIG. 2, the transport guide 55 includes an upper transport guide 55*a* disposed on the upper side and a lower transport guide 55*b* disposed on the lower side so as to oppose the upper transport guide 55*a*. The sheet-transport roller pair 54 serves as, for example, rollers (registration rollers) for adjusting the timing of transporting the recording sheet 5 to the second transfer position T2. Furthermore, two transport belts 57 and 58, which transport the recording sheet 5 discharged from the second transfer roller 31 of the second transfer device 30 after the second transfer to the fixing device 40, are provided between the second transfer device 30 and the fixing device 40. In addition, a sheet output roller pair 60, which outputs the recording sheet 5 discharged from the fixing device 40 after fixing onto a sheet output part 59 provided on a side surface of the body la, is provided near the discharge port for the recording sheet 5 in the body 1*a*.

A short transport belt 61 and a switching gate (not shown) for switching the sheet transport paths are provided between the fixing device 40 and the sheet output roller pair 60. When images are to be formed on both sides of a recording sheet 5, the recording sheet 5 having an image formed on one side thereof is directed downward by the switching gate, temporarily transporting the recording sheet 5 to a reversing path 64, which has sheet-transport roller pairs 62 and 63. While the recording sheet 5 is held by the sheet-transport roller pair 63, the transport direction is reversed such that the recording sheet 5 is transported from the reversing path 64, whereby the recording sheet 5 is reversed. The recording sheet 5 is then transported to the general feed-and-transport path 56 via a duplex-printing transport path 66, which includes multiple sheet-transport roller pairs 65, a transport guide (not shown), etc.

In FIG. 1, reference signs 145 (Y, M, C, and K) denote toner cartridges, which are arranged in the direction perpendicular to the plane of the sheet and store developer containing, at least, toner to be supplied to the corresponding developing devices 14 (Y, M, C, and K).

Furthermore, reference sign 100 in FIG. 1 denotes a controller for controlling, in a centralized manner, the operation of the image forming apparatus 1. The controller 100 includes a central processing unit (CPU), a read only memory (ROM), a random access memory (RAM), a bus connecting the CPU, ROM, etc. to one another, a communication interface, etc. (not shown). The controller 100 performs predetermined image processing on an image signal Cin, which is input from the outside, and then outputs image signals corresponding to the exposure devices 13 (Y, M, C, and K) of the yellow (Y), magenta (M), cyan (C) and black (K) image forming units 10.

Reference sign 101 denotes a power supply for supplying power to the controller 100 and the like, and reference sign 102 denotes an operating and display part via which a user operates the image forming apparatus 1. The operating and display part 102 includes a designating part (not shown) via which the user designates the recording sheet 5 to be used for image formation. The controller 100 identifies the grammage, flexural rigidity, and the like of the recording sheet 5, on the basis of the type (e.g., first thick paper, second thick paper, or normal paper), the paper feed direction, and the like of the recording sheet 5, designated via the operating and display part 102.

Operation of Image Forming Apparatus

A basic image forming operation performed by the image forming apparatus 1 will be described below.

Herein, an operation for forming a full-color image that is composed of toner images of four colors (Y, M, C, and K) by using the four image forming units 10 (Y, M, C, and K) will be described.

In the image forming apparatus 1, when the controller 100 receives, from the operating and display part 102, an image-forming-operation (printing) request instruction information with the designation of a recording sheet 5, the four image forming units 10 (Y, M, C, and K), the intermediate transfer device 20, the second transfer device 30, the fixing device 40, etc. are actuated.

In the image forming units 10 (Y, M, C, and K), first, the photoconductor drums 11 are rotated in the direction indicated by the arrow A, and the charging devices 12 charge the surfaces of the photoconductor drums 11 to a predetermined polarity (in the first exemplary embodiment, negative polarity) and predetermined electric potentials. Then, the exposure devices 13 (Y, M, C, and K) irradiate the charged surfaces of the photoconductor drums 11 with light LB, which is emitted on the basis of the image signals obtained by converting the image signal Cin, input to the image forming apparatus 1, to the respective color components (Y, M, C, and K), thereby forming, on the surfaces thereof, electrostatic latent images corresponding to the respective color components and having predetermined potential differences.

Next, in the image forming units 10 (Y, M, C, and K), the developing rollers 141 supply, to the electrostatic latent images of the respective color components, formed on the photoconductor drums 11, toners of corresponding colors (Y, M, C, and K) charged to a predetermined polarity (negative polarity) and make the toners electrostatically adhere thereto. As a result, the electrostatic latent images of the respective color components, formed on the photoconductor drums 11, become visible in the form of toner images of four colors (Y, M, C, and K) that have been developed with the toners of corresponding colors.

Then, when the respective color toner images formed on the photoconductor drums 11 of the image forming units 10 (Y, M, C, and K) are transported to the first transfer positions T1, the first transfer devices 15 sequentially first-transfer, in a superimposed manner, the respective color toner images to the intermediate transfer belt 21 of the intermediate transfer device 20, which is running in the direction indicated by the arrow B.

Once the first transfer has been completed, in the respective image forming units 10, the erase lamps 16 remove the residual charges on the surfaces of the photoconductor drums 11, and the drum cleaning devices 17 scrape off the attached substances, thereby cleaning the surfaces of the photoconductor drums 11. By doing this, the image forming units 10 can be used for the subsequent image forming operation.

Next, in the intermediate transfer device 20, the first-transferred toner images are transported to the second transfer position T2 by the revolving intermediate transfer belt 21. Meanwhile, in the paper feed device 50, a recording sheet 5 designated via the operating and display part 102 is fed into the feed-and-transport path 56, in accordance with the image forming operation. In the feed-and-transport path 56, the sheet-transport roller pair 54, serving as the registration rollers, feeds the recording sheet 5 to the second transfer position T2, via the transport guide 55, in accordance with the transfer timing.

At the second transfer position T2, the second transfer roller 31 of the second transfer device 30 second-transfers the superimposed toner images on the intermediate transfer belt 21 to the recording sheet 5. After the second transfer, in the intermediate transfer device 20, the belt cleaning device 27 removes attached substances, such as residual toner, on the surface of the intermediate transfer belt 21.

The recording sheet 5 to which the toner image has been second-transferred is separated from the intermediate transfer belt 21 and the second transfer roller 31 and is then transported to the fixing device 40 by the transport belts 57 and 58. The fixing device 40, by guiding the recording sheet 5 after the second transfer to the contact part between the rotating heating rotary member 41 and pressure-applying rotary member 42 and making it pass therebetween, performs necessary fixing processing (heating and pressing), thereby fixing the unfixed toner image to the recording sheet 5. Finally, when image formation is performed only on one side, the recording sheet 5 after fixing is output onto the sheet output part 59, which is provided at a side of the body 1a, by the sheet output roller pair 60.

When images are to be formed on both sides of a recording sheet 5, the recording sheet 5 provided with an image on one side is not output onto the sheet output part 59 by the sheet output roller pair 60, but is transported downward by the switching gate (not shown). The recording sheet 5 transported downward is reversed by the reversing path 64 having the sheet-transport roller pairs 62 and 63, and is then transported to the feed-and-transport path 56 via the duplex-printing transport path 66. Then, the sheet-transport roller pair 54 feeds the recording sheet 5 to the second transfer position T2 in accordance with the transfer timing. After an image is transferred and fixed to the back surface of the recording sheet 5, the recording sheet 5 is output onto the sheet output part 59, which is provided at a side of the body la, by the sheet output roller pair 60.

Through the operation described above, the recording sheet 5 on which a full-color image that is composed of toner images of four colors is formed is output.

Configuration of Characteristic Part of Image Forming Apparatus

In the image forming apparatus 1 configured as above, as shown in FIG. 2, the recording sheet 5 is fed, via the transport guide 55, to the second transfer position T2 by the sheet-transport roller pair 54, and the toner image T on the intermediate transfer belt 21 is second-transferred to the recording sheet 5 by a second-transfer electric field formed between the second transfer roller 31 and the belt-support roller 25. If the recording sheet 5 has a relatively high grammage or flexural rigidity, as in the case of thick paper, when the trailing end of the recording sheet 5 has passed through the upper transport guide 55*a*, the flexed (elastically deformed) recording sheet 5 tends to return to the original state by its own flexural rigidity, whereby a trailing end 5*a* of the recording sheet 5 strikes (collides with) the surface of the intermediate transfer belt 21, as shown in FIG. 3.

Figure 3:
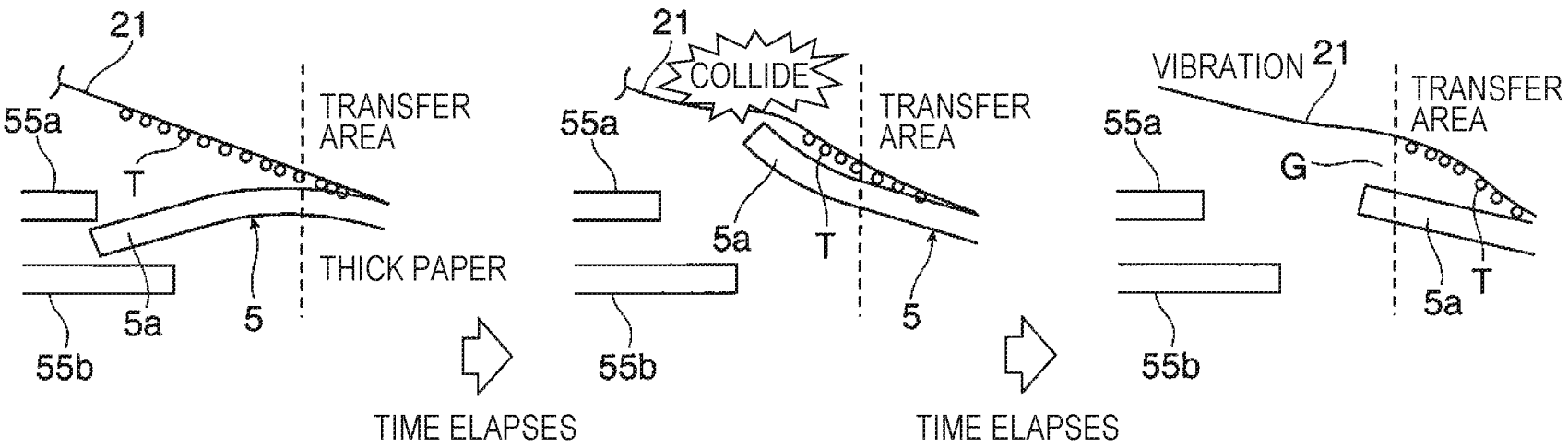
FIG. 3 shows how an image defect (white patches) occurs at the trailing end of a recording sheet.
Figure 4:
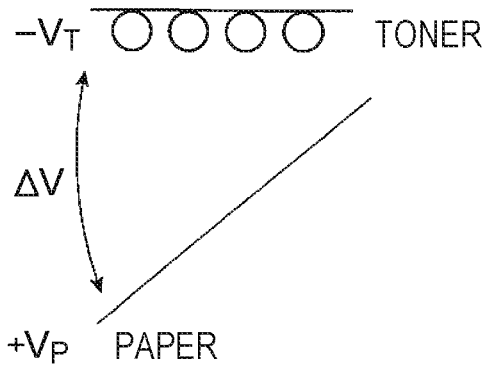
FIG. 4 shows a discharge occurring between an intermediate transfer belt and the recording sheet.
Figure 5:
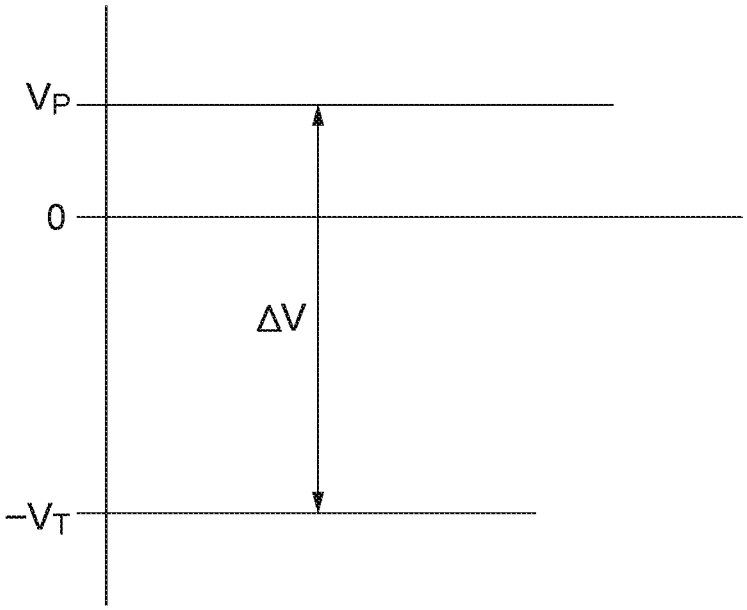
FIG. 5 is a graph showing the potential difference generated between the intermediate transfer belt and the recording sheet.
Figure 6:
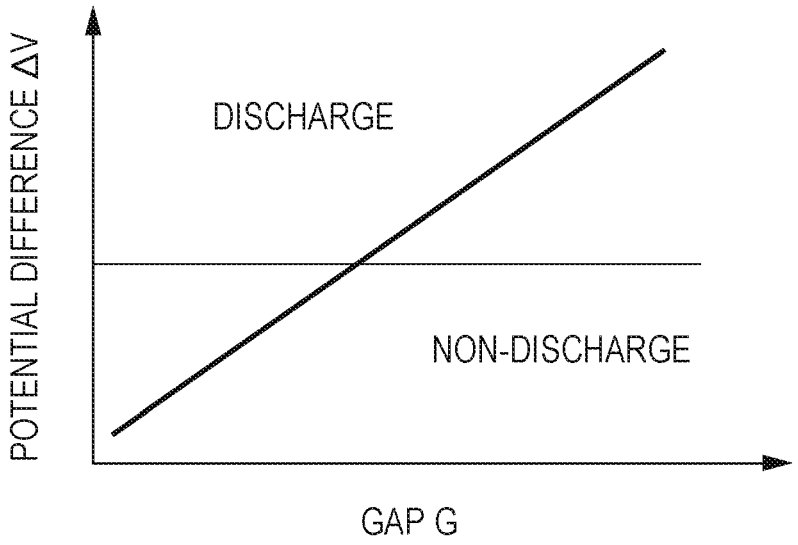
FIG. 6 is a graph showing the relationship between the size of a gap formed between the intermediate transfer belt and the recording sheet and the potential difference at which a discharge starts to occur.

As shown in FIG. 3, the intermediate transfer belt 21 is vibrated by an impact caused when the trailing end 5*a* of the recording sheet 5 collides with the intermediate transfer belt 21, and, when the intermediate transfer belt 21 is separated from the recording sheet 5, a gap G is formed between the intermediate transfer belt 21 and the recording sheet 5. The size of the gap G increases toward the downstream side in the transport direction of the recording sheet 5. When the gap G is formed between the intermediate transfer belt 21 and the trailing end 5*a* of the recording sheet 5, because the surface of the intermediate transfer belt 21 carries a toner image T having a negative charge of $-V_T$, and the recording sheet 5 has a charge of $+V_P$ as a result of being subjected to a positive high voltage applied by the second transfer roller 31 at the second transfer position T2, a discharge occurs at the gap G, depending on the potential difference, $\Delta V$, therebetween. Regarding the discharge occurring at the gap G, as shown in FIG. 6, the larger the size of the gap G is, the higher the potential difference at the beginning of the discharge is. Therefore, the discharge occurring at the gap G formed between the intermediate transfer belt 21 and the trailing end 5*a* of the recording sheet 5 tends to occur more frequently at positions on the further downstream side in the transport direction of the recording sheet 5.

Figure 7:
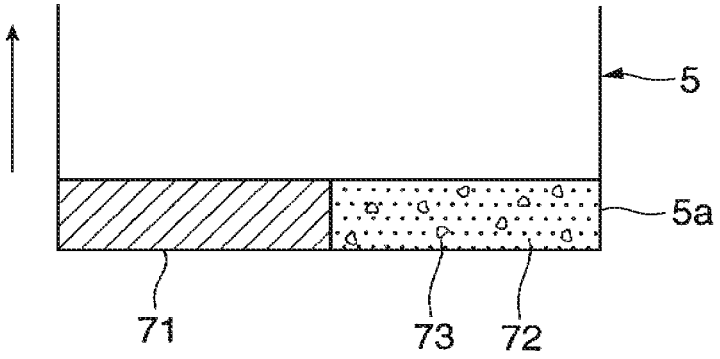
FIG. 7 shows an image defect (white patches) occurring in the recording sheet.

If a discharge occurs between the toner image T on the intermediate transfer belt 21 and the trailing end 5*a* of the recording sheet 5, the charge moves across the gap G, and, as a result, the toner image T carried by the intermediate transfer belt 21 tends to be charged to the opposite (positive) polarity to the initial charging polarity (negative polarity). At this time, as shown in FIG. 7, the toner image T transferred to the trailing end 5*a* of the recording sheet 5 may include, in the direction intersecting the transport direction of the recording sheet 5 (i.e., the width direction), a high-density image 71, which is relatively dense as a solid image, and a low-density image 72, which is relatively less dense as a monochrome halftone image. Typically, a relatively high positive transfer voltage is applied to the second transfer roller 31 so that the high-density image 71 can be appropriately transferred to the recording sheet 5. Therefore, the low-density image 72, which has a relatively low image density, has a relatively smaller amount of charge $-V_P$ than the high-density image 71, and when it is charged to the opposite (positive) polarity due to the discharge, the low-density image 72 tends to be charged to the opposite polarity. Because the toner image T charged to the opposite polarity is not transferred to the recording sheet 5 by the second-transfer electric field, as shown in FIG. 7, spot-like white patches 73, generated by the discharge, are produced in the low-density image 72. These spot-like white patches 73 are apparent in a halftone image, which has a uniform density, and thus deteriorate the image quality.

The white patches 73 in the image due to a discharge occur not only at the trailing end 5*a* of the recording sheet 5 on the downstream side in the transport direction, but also at the leading end 5*b* of the recording sheet 5 on the upstream side in the transport direction. The vibration caused by the trailing end 5*a* of the recording sheet 5 on the downstream side in the transport direction colliding with the surface of the intermediate transfer belt 21 when being separated from the transport guide 55 is more apparent with thick paper, which exerts a relatively large restring force when returning from the deformed state, and sheets having high flexural rigidity values.

Figure 8A:
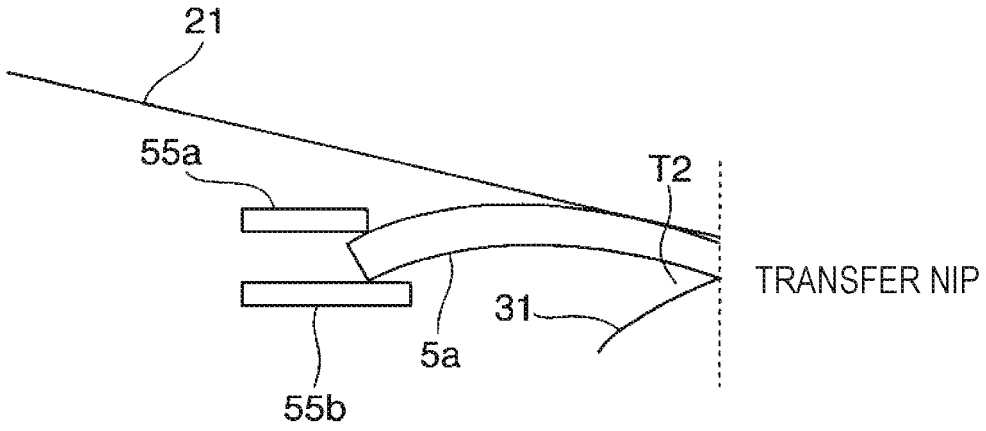
FIGS. 8A and 8B are schematically show a configuration for suppressing a discharge occurring between the intermediate transfer belt and the recording sheet.
Figure 8B:
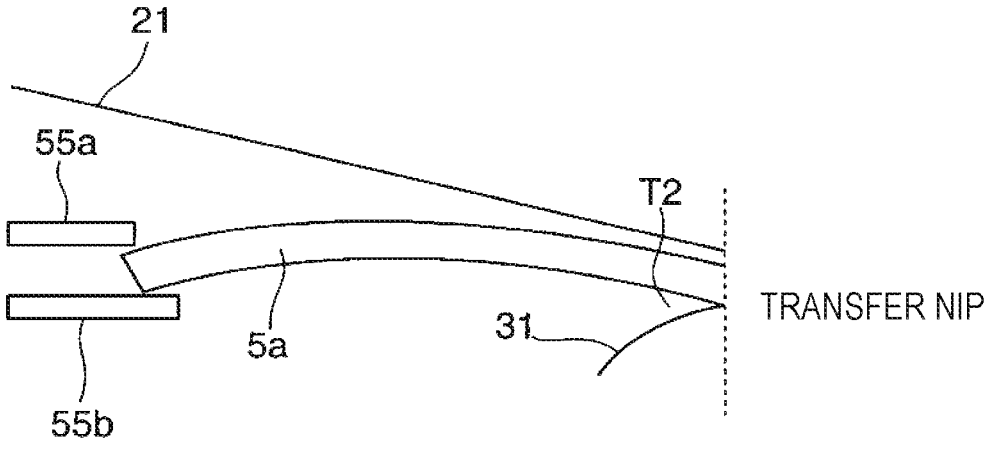

To suppress the vibration caused by the downstream end of the recording sheet 5 in the transport direction colliding with the surface of the intermediate transfer belt 21 when being separated from the transport guide 55, a configuration as shown in FIGS. 8A and 8B, in which a rear end of the transport guide 55, in the transport direction, is disposed at a position away from the second transfer position T2 to reduce the stress due to the flexure of the recording sheet 5 may be considered.

Figure 9A:
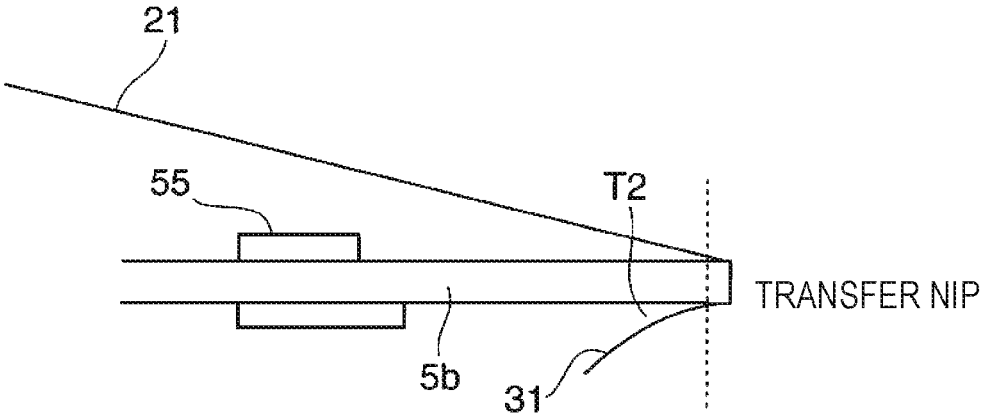
FIGS. 9A and 9B show how white patches occur at the leading end of a recording sheet.
Figure 9B:
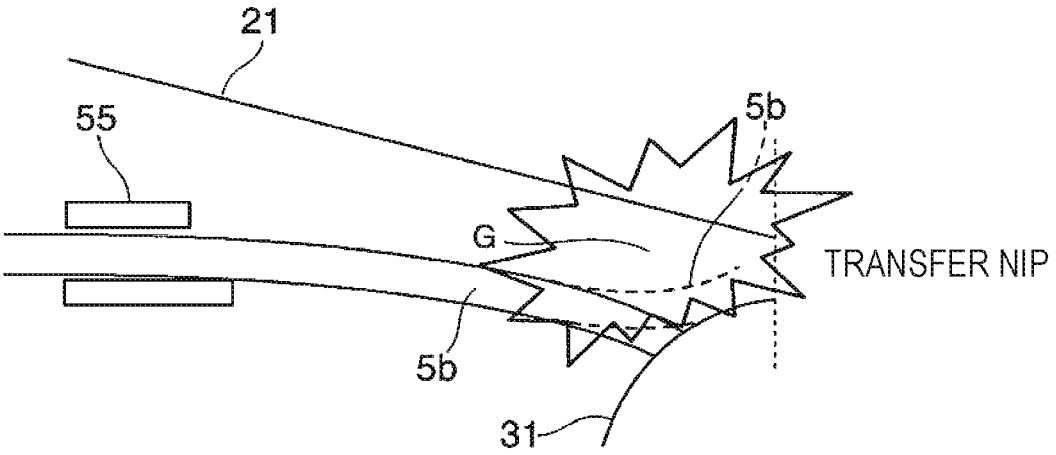

However, if the transport guide 55 for guiding the recording sheet 5 is disposed at a position away from the second transfer position, as shown in FIGS. 9A and 9B, when the leading end 5*b* of the recording sheet 5 in the transport direction enters the second transfer position T2 while being guided by the transport guide 55, the leading end 5*b* of the recording sheet 5 is transported to a position away from the intermediate transfer belt 21 due to its own weight. Thereafter, when the leading end 5*b* of the recording sheet 5 comes into contact with the second transfer roller 31 and moves to the second transfer position T2, as shown in FIG. 9B, a gap G is formed between the intermediate transfer belt 21 and the leading end 5*b* of the recording sheet 5. If the gap G is formed between the intermediate transfer belt 21 and the leading end 5*b* of the recording sheet 5, a discharge occurs at the gap G, producing the white patches 73 in the low-density image 72, when the image includes the high-density image 71 and the low-density image 72, as described above.

To counter this problem, in this exemplary embodiment, as shown in FIG. 2, a charging mechanism 80, serving as an example of a charge-applying part, which applies a charge having the same (negative) polarity as the charging polarity of the toner to at least one of the leading end 5*b* and the trailing end 5*a* of the recording sheet 5 in the transport direction is provided on the upstream side of the second transfer position T2 and on the downstream side of the sheet-transport roller pair 54 in the transport direction of the recording sheet 5. The charging mechanism 80 is disposed on the downstream side of the sheet-transport roller pair 54 and on the upstream side of the transport guide 55 in the transport direction of the recording sheet 5.

The charging mechanism 80 includes a pair of charging rollers 81 and 82, which are in contact with each other from above and below so as to be rotatable. One charging roller, 81, is formed of, for example, a metal core and a conductive elastic layer formed on the outer circumference thereof, similarly to the charging devices 12. The other charging roller, 82, is formed of a cylindrical metal roller. The charging roller 82 is disposed at a fixed position so as to be rotatable, whereas the charging roller 81 is urged against the charging roller 82 by a pressing device (not shown) at a predetermined pressure, so as to be rotatable. The charging roller 81 is provided with a high voltage having the same (negative) polarity as the charging polarity of the toner by a high-voltage power supply 83. The charging roller 82 is grounded. The application timing and voltage value of the high voltage applied to the charging roller 81 by the high-voltage power supply 83 are controlled by the controller 100.

In this exemplary embodiment, the charging mechanism 80 applies a charge having the same (negative) polarity as the charging polarity of the toner only to the leading end 5*b* and the trailing end 5*a* of the recording sheet 5. Herein, the leading end 5*b* and the trailing end 5*a* of the recording sheet 5 include areas extending from the leading end and the trailing end of the recording sheet 5 to positions at a predetermined length L from the leading end and the trailing end of the recording sheet 5. Although the predetermined length L is set to, for example, about 20 to 50 mm, it is not limited thereto. The charging mechanism 80 applies a charge having the same (negative) polarity as the charging polarity of the toner only to the leading end 5*b* and the trailing end 5*a* of the recording sheet 5, not to the area other than the leading end 5*b* and the trailing end 5*a* of the recording sheet 5, that is, the overall surface of the recording sheet 5. If a charge having the same (negative) polarity as the charging polarity of the toner is applied to the overall surface of the recording sheet 5, the negative charge applied to the overall surface of the recording sheet 5 and the toner image on the intermediate transfer belt 21, which has a negative charge, repel each other, causing an image defect in the area other than the leading end 5*b* and the trailing end 5*a* of the recording sheet 5. Thus, it is inappropriate.

Operation of Characteristic Part of Image Forming Apparatus

The operation of the characteristic part of the image forming apparatus 1 will be described below.

As shown in FIG. 1, in the image forming apparatus 1 according to this exemplary embodiment, the paper feed device 50 feeds a recording sheet 5 into the feed-and-transport path 56, in accordance with an image forming operation. In the feed-and-transport path 56, the sheet-transport roller pair 54, serving as the registration rollers, supplies the recording sheet 5 to the second transfer position T2 via the transport guide 55, in accordance with the transfer timing of the toner image T supported on the intermediate transfer belt 21.

At this time, if the controller 100 determines that the recording sheet 5 is second thick paper, which has a grammage of 200 g/m$^2$ or more, on the basis of the signal from the operating and display part 102, as shown in FIG. 2, the charging mechanism 80 uniformly applies a charge having the same (negative) polarity as the charging polarity of the toner to the leading end 5*b* and the trailing end 5*a* of the recording sheet 5, over the predetermined length L.

When the recording sheet 5 has a relatively high grammage or flexural rigidity, as in the case of thick paper, as shown in FIG. 3 and as described above, when the trailing end of the recording sheet 5 has passed through the transport guide 55, the flexed (elastically deformed) recording sheet 5 tends to return to the original state due to its own flexural rigidity, and, as a result, the trailing end 5*a* of the recording sheet 5 strikes (collides with) the surface of the intermediate transfer belt 21. Hence, a discharge occurs at the gap G formed between the intermediate transfer belt 21 and the trailing end 5*a* of the recording sheet 5.

At this time, as shown in FIG. 8B, by disposing the transport guide 55 at a position farther from the second transfer position T2 than that in the conventional configuration, the flexure occurring when the trailing end of the recording sheet 5 has passed through the transport guide 55 can be reduced, making it possible to reduce the impact caused when the trailing end 5*a* of the recording sheet 5 strikes (collides with) the surface of the intermediate transfer belt 21.

However, with this configuration, as shown in FIGS. 9A and 9B and as described above, when the leading end 5*b* of the recording sheet 5 enters the second transfer position T2, the gap G is formed between the intermediate transfer belt 21 and the leading end 5*b* of the recording sheet 5, leading to another risk of a discharge occurring at the gap G.

To counter these problems, in this exemplary embodiment, a charge having the same (negative) polarity as the charging polarity of the toner is applied to both the leading end 5*b* and the trailing end 5*a* of the recording sheet 5, over a predetermined length L, using the charging mechanism 80. As shown in FIG. 8B, if it is possible to reduce the flexure occurring when the trailing end of the recording sheet 5 has passed through the transport guide 55 by disposing the transport guide 55 at a position farther away from the second transfer position T2 than that in the conventional configuration, reducing the discharge occurring at the gap G formed between the intermediate transfer belt 21 and the trailing end 5*a* of the recording sheet 5 to a negligible level, a charge having the same (negative) polarity as the charging polarity of the toner may be applied only to the leading end 5*b* of the recording sheet 5, over the predetermined length L, using the charging mechanism 80. Note that the predetermined length L at the leading end 5*b* of the recording sheet 5 and the predetermined length L at the trailing end 5*a* of the recording sheet 5 do not necessarily have to be the same, and they may be differentiated.

Similarly, as shown in FIG. 8A, if it is possible to reduce the discharge occurring at the gap G formed between the intermediate transfer belt 21 and the leading end 5*b* of the recording sheet 5 when the leading end of the recording sheet 5 enters the second transfer position T2 to a negligible level by disposing the transport guide 55 at a position close to the second transfer position T2, a charge having the same (negative) polarity as the charging polarity of the toner may be applied only to the trailing end 5*a* of the recording sheet 5, over the predetermined length L, using the charging mechanism 80.

In this exemplary embodiment, a charge having the same (negative) polarity as the charging polarity of the toner is applied to both the leading end 5*b* and the trailing end 5*a* of the recording sheet 5, over the predetermined length L, using the charging mechanism 80. Hence, even when the gap G is formed between the intermediate transfer belt 21 and the trailing end 5*a* of the recording sheet 5 as a result of the trailing end 5*a* of the recording sheet 5 striking (colliding with) the surface of the intermediate transfer belt 21, because the trailing end 5*a* of the recording sheet 5 is charged to the same (negative) polarity as the charging polarity of the toner, the occurrence of a discharge at the gap G can be prevented or suppressed.

Because the occurrence of a discharge between the intermediate transfer belt 21 and the trailing end 5*a* of the recording sheet 5 is prevented or suppressed, even when the toner image T to be transferred to the trailing end 5*a* of the recording sheet 5 includes, in the direction intersecting the transport direction of the recording sheet 5, the high-density image 71, which is relatively dense as a solid image, and the low-density image 72, which is relatively less dense as a monochrome halftone image, as shown in FIG. 7, the toner image T of the low-density image 72, which has a relatively low image density, is not or less likely to be charged to the opposite polarity, as a result of the discharge. Accordingly, the occurrence of the spot-like white patches 73 in the low-density image 72 due to the discharge is prevented or suppressed.

Similarly, because the occurrence of a discharge between the intermediate transfer belt 21 and the leading end 5*b* of the recording sheet 5 is prevented or suppressed, even when the toner image T to be transferred to the leading end 5*b* of the recording sheet 5 includes, in the direction intersecting the transport direction of the recording sheet 5, the high-density image 71, which is relatively dense as a solid image, and the low-density image 72, which is relatively less dense as a monochrome halftone image, as shown in FIG. 7, the toner image T of the low-density image 72, which has a relatively low image density, is not or less likely to be charged to the opposite polarity, as a result of the discharge. Accordingly, the occurrence of the spot-like white patches 73 in the low-density image 72 due to the discharge is prevented or suppressed.

EXAMPLE 1

The inventors produce a benchmark model of the image forming apparatus 1, as shown in FIG. 1, which is a four-color high-speed tandem machine, and check for white patches in an image. The machine used for the evaluation is a four-color high-speed tandem machine with a process speed of 440 mm/s and a productivity of 100 ppm, manufactured by Fuji Xerox Co., Ltd. A direct-current power supply is used as the high-voltage power supply of the charging mechanism 80, and a voltage of −1800V is uniformly applied. The paper used for the evaluation is New DV (tradename) having a grammage of 400 g/m$^2$, which is an A3-size specialty white paperboard manufactured by Hokuetsu Kishu Sales Co., Ltd. The image used for the evaluation includes, in the direction intersecting the transport direction of the recording sheet 5, a 100% blue solid image extending from the center to one end and a 50% black halftone image extending from the center to the other end. A charge having the same polarity as the charging polarity of the toner is applied to the trailing end of the recording sheet 5 in the transport direction, using the charging mechanism 80, and the second transfer voltage is set to a value with which the 100% blue solid image is satisfactorily transferred to the recording sheet 5, and, in this state, the image-quality grade of the 50% black halftone image is evaluated. The image-quality grade is evaluated in five grades: very poor (5), poor (4), slightly poor (3), good (allowable) (2), and excellent (1).

Figure 10:
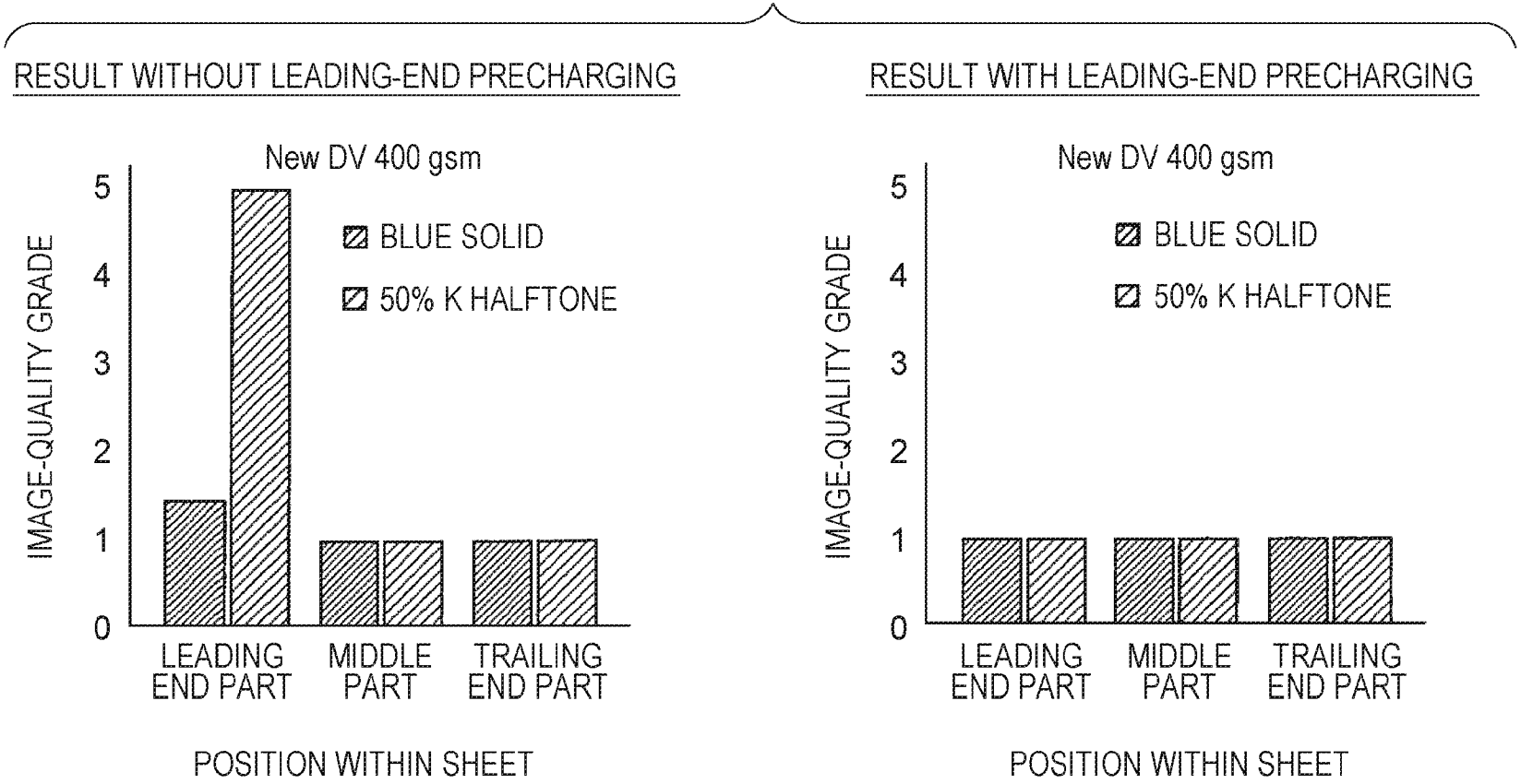
FIG. 10 includes graphs showing the results of Example 1.

FIG. 10 includes graphs showing the evaluation results of Example 1.

As is clear from FIG. 10, when a charge having the same (negative) polarity as the charging polarity of the toner is applied to the leading end 5*b* of the recording sheet 5, using the charging mechanism 80, no white patch appears in the 50% black halftone image at any of the leading end 5*b*, the middle part, and the trailing end of the recording sheet 5, and the image-quality grade is 1, "excellent".

In contrast, when a charge having the same (negative) polarity as the charging polarity of the toner is not applied to the leading end 5*b* of the recording sheet 5, using the charging mechanism 80, noticeable white patches are generated in the 50% black halftone image at the leading end 5*b* of the recording sheet 5, and the image-quality grade is 5, "very poor".

As is clear from FIG. 10, even when a charge having the same (negative) polarity as the charging polarity of the toner is not applied to the trailing end 5*a* of the recording sheet 5, using the charging mechanism 80, no white patch is generated in the 50% black halftone image at the trailing end of the recording sheet 5, and the image-quality grade is 1, "excellent". The reason for this may be considered that, as shown in FIG. 8B, because the transport guide 55 is disposed at a position away from the second transfer position T2, the impact applied to the trailing end 5*a* of the recording sheet 5 is small, and thus, the influence of the waving of the intermediate transfer belt 21 is small.

COMPARATIVE EXAMPLE 1

To confirm the difference in level of the white patches generated in 50% black halftone images due to the difference in type of the recording sheet 5, the inventors perform the following evaluation (Comparative Example 1). In Comparative Example 1, unlike the configuration in Example 1, the charging mechanism 80 is not provided, and New DV (trade name) having a grammage of 400 g/m$^2$, which is an A3-size specialty white paperboard manufactured by Hokuetsu Kishu Sales Co., Ltd., and OS coated paper W having a grammage of 127 g/m$^2$, which is an A3-size gloss two-sided coated paper manufactured by Fuji Xerox Co., Ltd., which is processed by a high-precision paper cutter and is subjected to a paper dust removal treatment, are used as the recording sheets 5.

Figure 11:
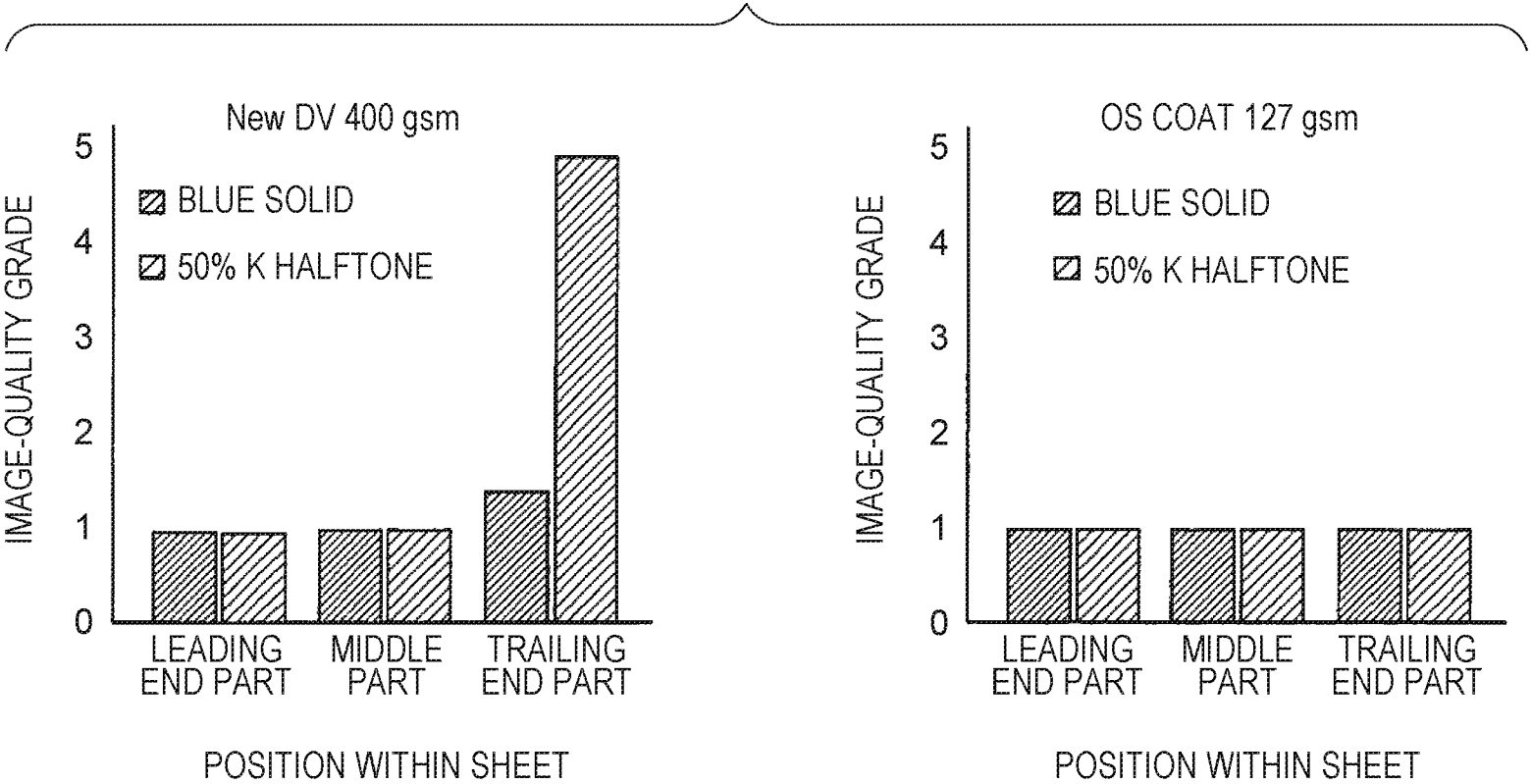
FIG. 11 includes graphs showing the results of Comparative Example 1.

FIG. 11 includes graphs showing the evaluation results of Comparative Example 1.

As is clear from FIG. 11, when the recording sheet 5 is second thick paper having a very large grammage of 400 g/m$^2$, noticeable white patches are generated in the 50% black halftone image at the trailing end 5*a* of the recording sheet 5, and the image-quality grade is 5, "very poor.

In contrast, when the recording sheet 5 is first thick paper having a relatively small grammage of 127 g/m$^2$, no white patch is generated in the 50% black halftone image at the trailing end 5*a* of the recording sheet 5, and the image-quality grade is 1, "excellent".

Second Exemplary Embodiment

Figure 12:
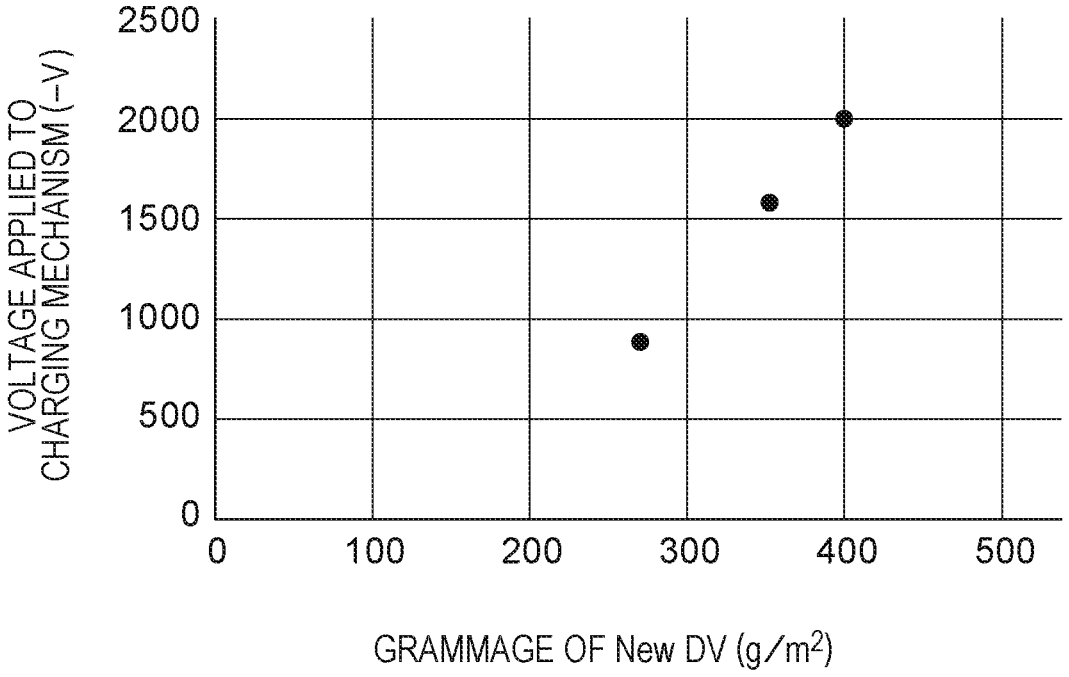
FIG. 12 is a graph showing an operation of an image forming apparatus according to a second exemplary embodiment of the present invention.

FIG. 12 is a graph showing the voltage to be applied to the charging mechanism 80 of the image forming apparatus according to a second exemplary embodiment of the present invention. The voltage is changed according to the grammage of the recording sheet 5. Specifically, the voltage to be applied to the charging mechanism 80 increases linearly (like a linear function) with the grammage of the recording sheet 5.

FIG. 12 is a graph showing the voltages to be applied to the charging mechanism 80, which applies a charge to the trailing end 5*a* of the recording sheet 5, to achieve the best result, i.e., the image-quality grade 1, when the recording sheet 5 (New DV (trade name), which is a specialty white paperboard manufactured by Hokuetsu Kishu Sales Co., Ltd.) has a grammage of 270 g/m$^2$, 350 g/m$^2$, and 400 g/m$^2$.

As a result, as is clear from FIG. 12, it is confirmed that the larger the grammage of the recording sheet 5 is, the higher the voltage to be applied to the charging mechanism 80. The reason for this may be considered that, because the gap G between the trailing end 5*a* of a recording sheet 5 and the intermediate transfer belt 21 is larger in a recording sheet 5 having a larger grammage, due to the difference in flexural rigidity of recording sheets 5, a greater potential difference ΔV is generated.

Third Exemplary Embodiment

Figure 13:
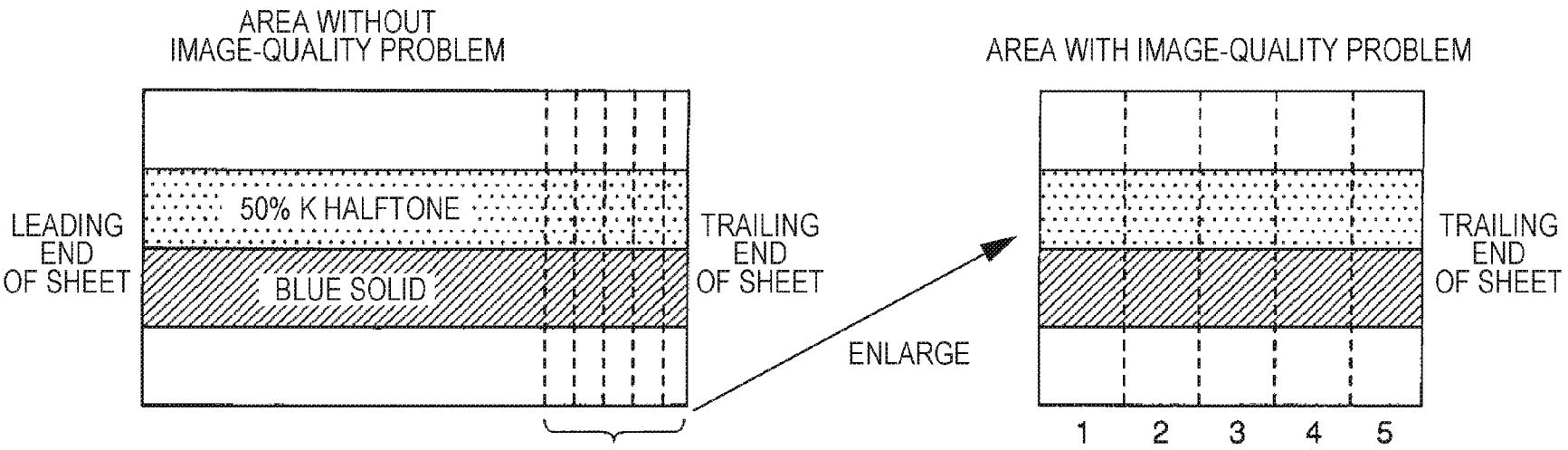
FIG. 13 shows a relevant part of an image forming apparatus according to a third exemplary embodiment of the present invention.

FIG. 13 shows a configuration in which the voltage to be applied to the charging mechanism 80 of the image forming apparatus according to a third exemplary embodiment of the present invention is changed according to the distance from the end of the recording sheet 5.

In the third exemplary embodiment, as shown in FIG. 13, the trailing end area of the recording sheet 5 in the transport direction is divided into five areas each having a predetermined length ΔL (herein, 10 mm) according to the distance from the trailing end of the recording sheet 5, and the voltage to be applied to the charging mechanism 80 is varied among these areas.

Figures 14, 15:
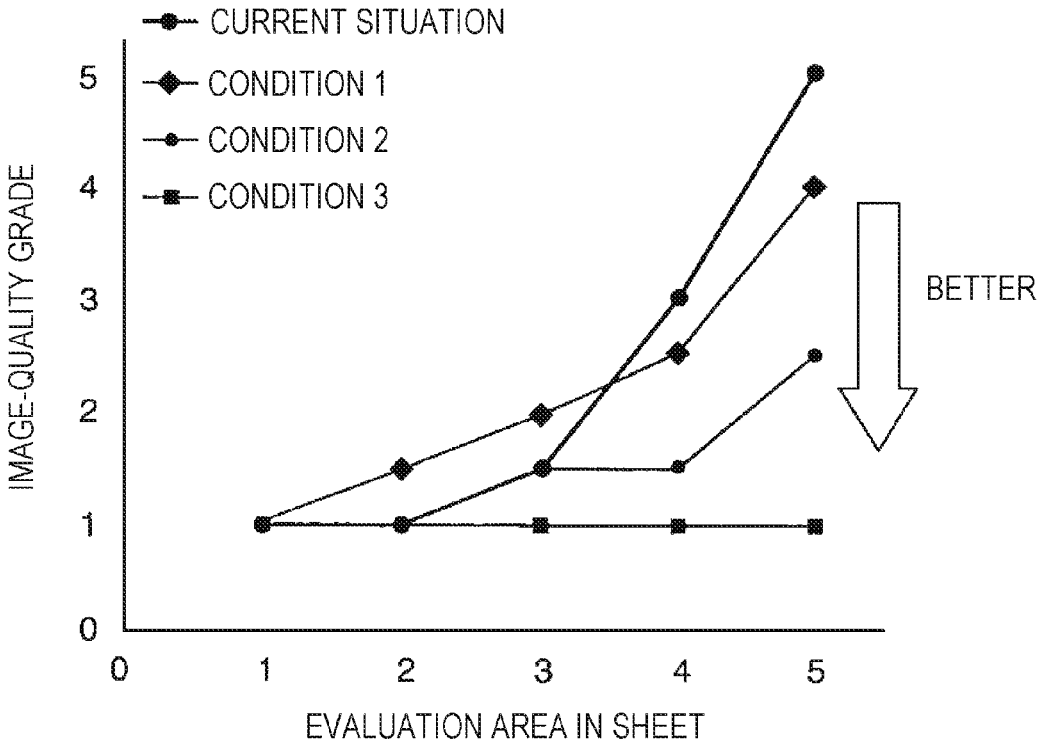
FIG. 14 is a table of voltages to be applied to a charging mechanism of the image forming apparatus according to the third exemplary embodiment of the present invention.
FIG. 15 is a graph showing the evaluation results of Example 2.

In the third exemplary embodiment, as shown in FIG. 14, the controller 100 varies the voltage to be applied to the charging mechanism 80 among the respective areas of the recording sheet 5.

EXAMPLE 2

The inventors produce a benchmark model of the image forming apparatus 1, as shown in FIG. 1, which is a four-color high-speed tandem machine, and check for white patches in an image, under the same condition as that of Example 1. However, the voltage to be applied to the charging mechanism 80 is varied according to the distance from the trailing end of the recording sheet 5, as shown in FIG. 14.

In Condition 1, only the voltage to be applied to the charging mechanism 80 with respect to the area 1 is set to 0 V, and the voltages to be applied to the charging mechanism 80 with respect to the areas 2 to 5 are set uniformly to −800 V.

In Condition 2, the voltage to be applied to the charging mechanism 80 with respect to the area 1 is set to 0 V, the voltage to be applied to the charging mechanism 80 with respect to the area 2 is set to −350 V, the voltage to be applied to the charging mechanism 80 with respect to the area 3 is set to −650 V, the voltage to be applied to the charging mechanism 80 with respect to the area 4 is set to −1100 V, and the voltage to be applied to the charging mechanism 80 with respect to the area 5 is set to −1500 V.

In Condition 3, the voltage to be applied to the charging mechanism 80 with respect to the area 1 is set to 0 V, the voltage to be applied to the charging mechanism 80 with respect to the area 2 is set to −350 V, the voltage to be applied to the charging mechanism 80 with respect to the area 3 is set to −500 V, the voltage to be applied to the charging mechanism 80 with respect to the area 4 is set to −1350 V, and the voltage to be applied to the charging mechanism 80 with respect to the area 5 is set to −2100 V.

FIG. 15 is a graph showing the evaluation result of Example 2.

As is clear from FIG. 15, in Condition 1, the image-quality grades in the evaluation areas 2 and 3 are poorer than those in the current situation, and, although the image-quality grades in the evaluation areas 4 and 5 are better than those in the current situation, the image-quality grades are from about 2.5 to 4, which both exceed the allowable image-quality grade 2. Thus, the result is unsatisfactory.

In Condition 2, although the image quality is better than that is Condition 1, the image-quality grades in the evaluation areas 2 and 3 are about the same as those in the current situation, and the image-quality grade in the evaluation area 5 exceed the allowable image-quality grade 2. Thus, the result is also unsatisfactory.

In contrast, in Condition 3, the image-quality grades in the evaluation areas 1 to 5 are all 1, "excellent", showing that a satisfactory image-quality improving effect can be obtained.

EXAMPLE 3

Next, the inventors produce a benchmark model of the image forming apparatus 1, as shown in FIG. 1, which is a four-color high-speed tandem machine, and check for white patches in an image, using the same condition as that used in Example 1. However, the voltages to be applied to the charging mechanism 80 are set constant, as shown in FIG. 16, without changing according to the distance from the trailing end of the recording sheet 5.

In Condition 1, the voltages to be applied to the charging mechanism 80 with respect to the areas 1 to 5 are set uniformly to −800 V. In Condition 2, the voltages to be applied to the charging mechanism 80 with respect to the areas 1 to 5 are set uniformly to −1500 V. In Condition 3, the voltages to be applied to the charging mechanism 80 with respect to the areas 1 to 5 are set uniformly to −2100 V.

Figures 16, 17:
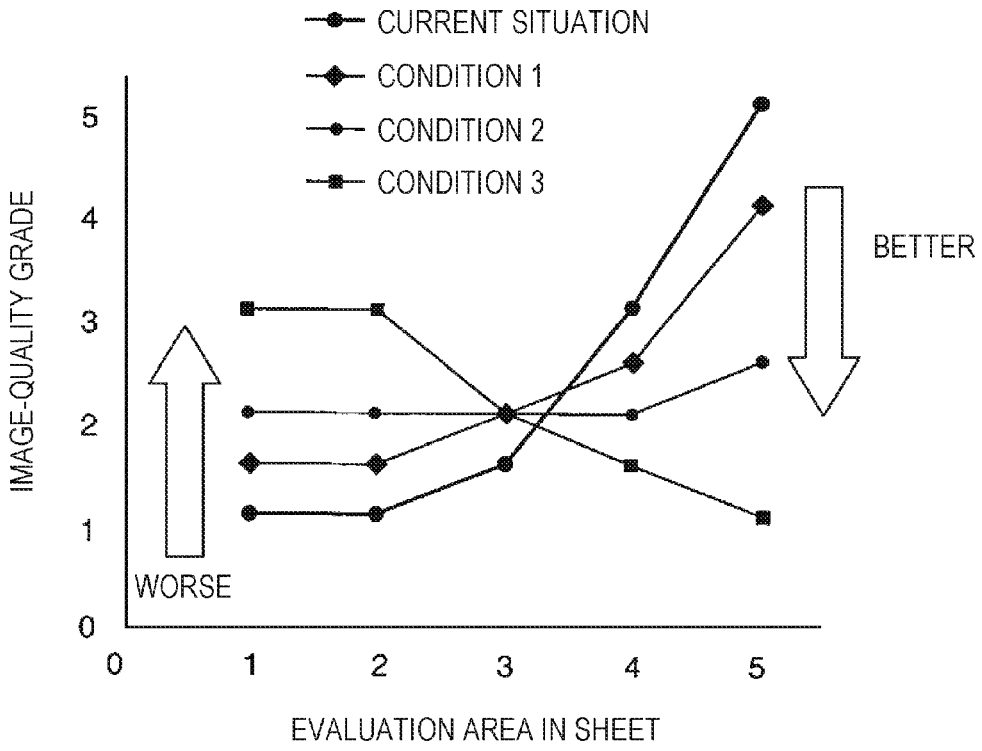
FIG. 16 is a table of voltages to be applied to the charging mechanism of the image forming apparatus according to the third exemplary embodiment of the present invention.
FIG. 17 is a graph showing the evaluation results of Example 3.

FIG. 17 is a graph showing the evaluation result of Example 3.

As is clear from FIG. 17, in Condition 1, although the image-quality grades in the evaluation areas 1 to 3 are slightly worse than those in the current situation, the image-quality grades are 2, "good (allowable)", and the image-quality grades in the evaluation areas 4 and 5 are better than those in the current situation.

In Condition 2, the image-quality grades in the evaluation areas 1 to 5 are about 2, "good (allowable)", or 2.5. Thus, the result is satisfactory.

In Condition 3, although the image-quality grades in the evaluation areas 1 and 2 are worse than those in the current situation, the image-quality grade is 3, "slightly poor", which is still usable, and the image-quality grades in the evaluation areas 3 to 5 are 2, "good (allowable)". Thus, the result is satisfactory.

Fourth Exemplary Embodiment

An image forming apparatus 1 according to a fourth exemplary embodiment is configured such that the amount of charge applied to a recording medium is varied between when an image is to be formed on one side of the recording medium and when images are to be formed on both sides of the recording medium.

More specifically, in the fourth exemplary embodiment, when images are to be formed on both sides of a recording sheet 5, the controller 100 sets a larger absolute value of voltage to be applied to the charging mechanism 80 than that when an image is to be formed on one side. By doing so, when images are to be formed on both sides, it is possible to charge the recording sheet 5, which has already been subjected to fixing processing by the fixing device 40 and thus has been increased in resistance value, to the same polarity as the charging polarity of the toner.

Thus, when images are to be formed on both sides, it is possible to suppress the generation of white patches at the ends of the recording sheet in the transport direction.

Although, in the above-described exemplary embodiments, the configuration in which the controller 100 controls the voltage to be applied to the charging mechanism 80 has been described, it is also possible to configure such that a user switches or sets, via the operating and display part 102, whether or not a charge is applied to the recording sheet 5, according to the type of the recording sheet 5.

Furthermore, although, in the above-described exemplary embodiments, the case where the charging mechanism 80 formed of the charging rollers is used as the charge-applying part has been described, the charge-applying part may be formed of, besides the charging rollers, a charging blush, a charging blade, sheet metal, corotron, or the like.

Furthermore, although, in the above-described exemplary embodiments, the case where a direct-current high voltage is applied to the charging mechanism 80, serving as the charge-applying part, has been described, the voltage applied to the charging mechanism 80 is not limited thereto, and an alternating-current voltage superposed on the direct-current voltage may also be used. In such a case, it is possible to stably improve the charge applying efficiency, regardless of the resistance and the moisture content of the recording sheet 5.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a plurality of image carriers configured to carry toner images of different colors;

an intermediate transfer body configured to carry the toner images transferred from the plurality of image carriers;

a second transfer part configured to transfer the toner images carried by the intermediate transfer body to a recording medium at a second transfer position; and a charge-applying part configured to apply a charge having a same polarity as a charging polarity of toner used to form the toner images to at least one of a leading end and a trailing end of the recording medium in a transport direction, at a position on an upstream side of the second transfer part in the transport direction of the recording medium, wherein the charge-applying part is configured to change an amount of charge to be applied to the recording medium according to a grammage of the recording medium.

2. The image forming apparatus according to claim 1, wherein the charge-applying part is configured to increase the amount of charge applied as a distance to the leading end or the trailing end of the recording medium in the transport direction is reduced.

3. The image forming apparatus according to claim 1, wherein the charge-applying part is configured to vary the amount of charge applied to the recording medium between when an image is formed on one side of the recording medium and when images are formed on both sides of the recording medium.

4. An image forming apparatus comprising:

a plurality of image carriers configured to carry toner images of different colors;

an intermediate transfer body configured to carry the toner images transferred from the plurality of image carriers;

a second transfer part configured to transfer the toner images carried by the intermediate transfer body to a recording medium at a second transfer position; and a charge-applying part configured to apply a charge having a same polarity as a charging polarity of toner used to form the toner images to at least one of a leading end and a trailing end of the recording medium in a transport direction, at a position on an upstream side of the second transfer part in the transport direction of the recording medium, wherein the charge-applying part is configured to increase the amount of charge applied as a distance to the leading end or the trailing end of the recording medium in the transport direction is reduced.

5. The image forming apparatus according to claim 4, wherein the charge-applying part is configured to change the amount of charge to be applied to the recording medium according to a property of the recording medium.

6. An image forming apparatus comprising:

a plurality of image carriers configured to carry toner images of different colors;

an intermediate transfer body configured to carry the toner images transferred from the plurality of image carriers;

a second transfer part configured to transfer the toner images carried by the intermediate transfer body to a recording medium at a second transfer position; and a charge-applying part configured to apply a charge having a same polarity as a charging polarity of toner used to form the toner images to at least one of a leading end and a trailing end of the recording medium in a transport direction, at a position on an upstream side of the second transfer part in the transport direction of the recording medium, wherein the charge-applying part is configured to vary an amount of charge to be applied to the recording medium between when an image is formed on one side of the recording medium and when images are formed on both sides of the recording medium.

7. The image forming apparatus according to claim 6, wherein the charge-applying part is configured to change an amount of charge to be applied to the recording medium according to a property of the recording medium.

* * * * *